United States Patent [19]

Ishikawa et al.

[11] 4,383,512

[45] May 17, 1983

[54] AIR-FUEL RATIO CONTROL DEVICE OF AN INTERNAL COMBUSTION ENGINE

[75] Inventors: Norikatsu Ishikawa, Mishima; Hidemi Onaka, Susono; Haruyuki Obata, Susono; Takao Tate, Susono; Toshio Tanahashi, Susono; Isamu Hagino, Aichi, all of Japan

[73] Assignee: Toyota Jidosha Kogyo Kabushiki Kaisha, Toyota, Japan

[21] Appl. No.: 258,573

[22] Filed: Apr. 29, 1981

[30] Foreign Application Priority Data

May 14, 1980 [JP] Japan ..... 55/62707

[51] Int. Cl.[3] ..... F02M 7/24

[52] U.S. Cl. ..... 123/440; 123/328

[58] Field of Search ..... 123/440, 489, 493, 492, 123/589, 328; 60/276, 285

[56] References Cited

U.S. PATENT DOCUMENTS

| | | | |
|---|---|---|---|
| 3,895,611 | 7/1975 | Endo et al. | 123/489 |
| 4,059,088 | 11/1977 | Tateno et al. | 123/328 |
| 4,089,313 | 5/1978 | Asano et al. | 123/440 |
| 4,103,657 | 8/1978 | Minami | 123/440 |
| 4,132,199 | 1/1979 | Kuroiwa et al. | 123/440 |
| 4,187,812 | 2/1980 | Hosaka et al. | 123/489 |
| 4,278,060 | 7/1981 | Isobe et al. | 123/440 |
| 4,321,903 | 3/1982 | Kondo et al. | 123/440 |

*Primary Examiner*—Charles J. Myhre
*Assistant Examiner*—Andrew M. Dolinar
*Attorney, Agent, or Firm*—Cushman, Darby & Cushman

[57] ABSTRACT

An air-fuel ratio control device of an internal combustion engine having a carburetor. An air bleed passage is connected to a fuel outflow passage of the carburetor, and an electromagnetic control valve is arranged in the air bleed passage. The control valve is controlled by the detecting signal of an oxygen concentration detector arranged in the exhaust passage so that the air-fuel ratio of a mixture fed into the cylinder of an engine becomes equal to the stoichiometric air-fuel ratio. When the vehicle is decelerated, the mean value of the potential level, which has been applied to the electromagnetic control valve before deceleration, is stored. When the throttle valve is opened during the deceleration and, then, the oxygen concentration detector detects that a rich air-fuel mixture is fed into the cylinder of the engine, the above-mentioned mean value is instantaneously applied to the electromagnetic control valve.

22 Claims, 10 Drawing Figures

AIR-FUEL RATIO CONTROL DEVICE OF AN INTERNAL COMBUSTION ENGINE

DESCRIPTION OF THE INVENTION

The present invention relates to an air-fuel ratio control device of an internal combustion engine.

As a method of simultaneously reducing the amount of harmful HC, CO and $NO_X$ components in the exhaust gas, a method has been known, in which a three way catalytic converter is arranged in the exhaust passage of an engine.

The purifying efficiency of the three way catalyzer becomes maximum when the air-fuel ratio of the mixture fed into the cylinder of an engine becomes equal to the stoichiometric air-fuel ratio. Consequently, in the case wherein a three way catalytic converter is used for purifying the exhaust gas, it is necessary to equalize the air-fuel ratio of the mixture fed into the cylinder to the stoichiometric air-fuel ratio. As an air-fuel ratio control device capable of equalizing the air-fuel ratio of the mixture fed into the cylinder of an engine to the stoichiometric air-fuel ratio, an air-fuel ratio control device has been known in which an oxygen concentration detector is arranged in the exhaust passage located upstream of the three way catalytic converter, and a carburetor has an air bleed passage connected to a fuel outflow passage of the carburetor. The amount of air fed into the fuel outflow passage from the air bleed passage is controlled on the basis of the output signal of the oxygen concentration detector, so that the air-fuel ratio of the mixture formed in the carburetor becomes equal to the stoichiometric air-fuel ratio. In an engine equipped with such an air-fuel ratio control device, the amount of air fed into the fuel outflow passage from the air bleed passage is reduced in response to the output signal of the oxygen concentration detector when the air-fuel ratio of the mixture fed into the cylinder becomes larger than the stoichiometric air-fuel ratio, while the amount of air fed into the fuel outflow passage from the air bleed passage is increased in response to the output signal of the oxygen concentration detector when the air-fuel ratio of the mixture fed into the cylinder becomes smaller than the stoichiometric air-fuel ratio.

In general, then the engine is decelerated, the amount of fuel fed from the carburetor, relative to the amount of air fed into the cylinder, becomes small as compared with the case wherein the engine is operated under cruise and, thus, during deceleration, a lean air-fuel mixture continues to be fed into the cylinder. Consequently, since the amount of air bled into the fuel outflow passage from the air bleed passage continues to be reduced during deceleration, the electromagnetic value, controlling the amount of the bled air, is closed to a position near the fully closed position. However, if the throttle valve is opened during deceleration for accelerating the engine, since the electromagnetic valve is closed to a position near the fully closed position as mentioned above, a large amount of fuel is fed from the main nozzle of the carburetor and, as a result, a rich air-fuel mixture is fed into the cylinder. After this, when the oxygen concentration detector detects that such a rich air-fuel mixture is fed into the cylinder, the amount of air fed into the fuel outlet passage from the air bleed passage is gradually increased in response to the output signal of the oxygen concentration detector. Nevertheless, since the electromagnetic valve is closed to a position near the fully closed position as mentioned above, it takes a long time until the electromagnetic valve is opened to an opened degree which is necessary to form an air-fuel mixture of the stoichiometric air-fuel ratio. Consequently, immediately after the engine is accelerated during deceleration, a rich air-fuel mixture is fed into the cylinder and, as a result, a large amount of unburned HC and CO is discharged into the exhaust passage of the engine.

An object of the present invention is to provide an air-fuel ratio control device capable of sufficiently reducing the amount of unburned HC and CO which are produced when the engine is accelerated during deceleration.

According to the present invention, there is provided an air-fuel ratio control device of an internal combustion engine having at least one cylinder, an intake passage and an exhaust passage, said device comprising: a carburetor arranged in the intake passage and having a throttle valve, said carburetor having a fuel reservoir and a fuel outflow passage which interconnects sand reservoir to the intake passage;

an air bleed passage interconnecting said fuel outflow passage to the atmosphere for feeding air into said fuel outflow passage;

an air-fuel ratio detector arranged in the exhaust passage and detecting components of an exhaust gas in the exhaust passage for producing a detecting signal which has a potential level which becomes high or low when the air-fuel ratio of said mixture becomes less or larger than the stoichiometric air-fuel ratio, respectively;

a detecting signal processing circuit having a first comparator for comparing the level of the detecting signal of said air-fuel ratio detector with a reference voltage to produce an output voltage, said processing circuit having an integrating circuit for integrating the output voltage of said first comparator to produce a first control signal; a drive pulse generator in response to said first control signal for generating continuous drive pulses, each having a width which is proportional to the potential level of said first control signal, and; control valve means arranged in said air bleed passage and actuated in response to said drive pulses for increasing a flow area of said air bleed passage in accordance with an increase in the width of said drive pulse, wherein the improvement comprises: a vacuum sensitive switch in response to the vacuum within the intake passage located downstream of said throttle valvue for producing a detecting signal when the level of vacuum within the intake passage located downstream of said throttle valve becomes greater than a predetermined level; memory means in response to the detecting signal of said vacuum sensitive switch for storing the mean value of the potential level of the detecting signal which is issued from said air-fuel ratio detector before the level of vacuum within the intake passage located downstream of said throttle valve becomes greater than said predetermined level; converting means for converting said mean value stored in said memory means to a corresponding second control signal; control signal generating means in response to the detecting signal of said air-fuel ratio detector and the detecting signal of said vacuum sensitive switch for producing a third control signal when the potential level of the detecting signal of said air-fuel ratio detector becomes high after the level of vacuum within the intake passage located downstream of said throttle value becomes smaller than said predetermined level, and; switching means in response to the third control signal of said control signal generating means for temporarily changing a signal, input into said drive pulse generator, from said first control signal to said second control signal to temporarily generate continuous drive pulses, each having a width which is proportional to the potential level of said second control signal when said control signal generating means produces said third control signal.

The present invention may be more fully understood from the description of a preferred embodiment of the invention set forth below, together with the accompanying drawings.

DESCRIPTION OF A PREFERRED EMBODIMENT

Figure 1:
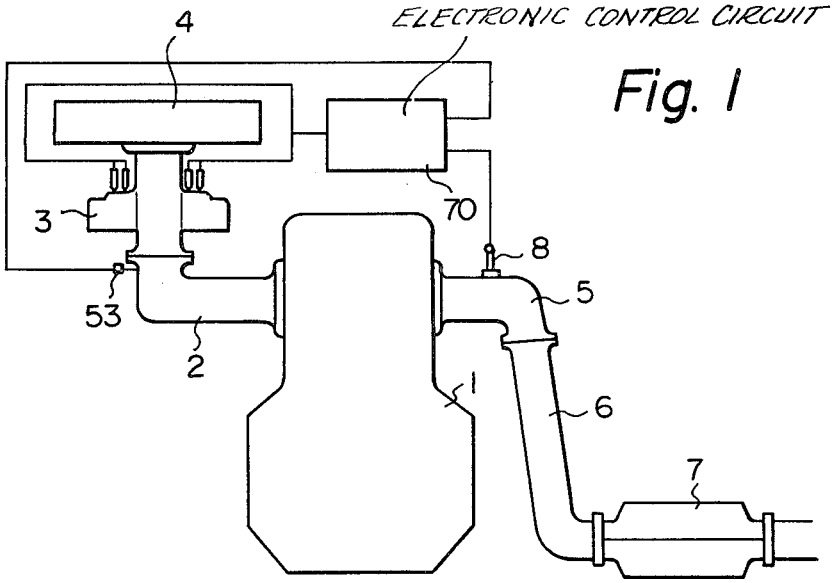
FIG. 1 is a front view of an internal combustion engine.
Figure 2:
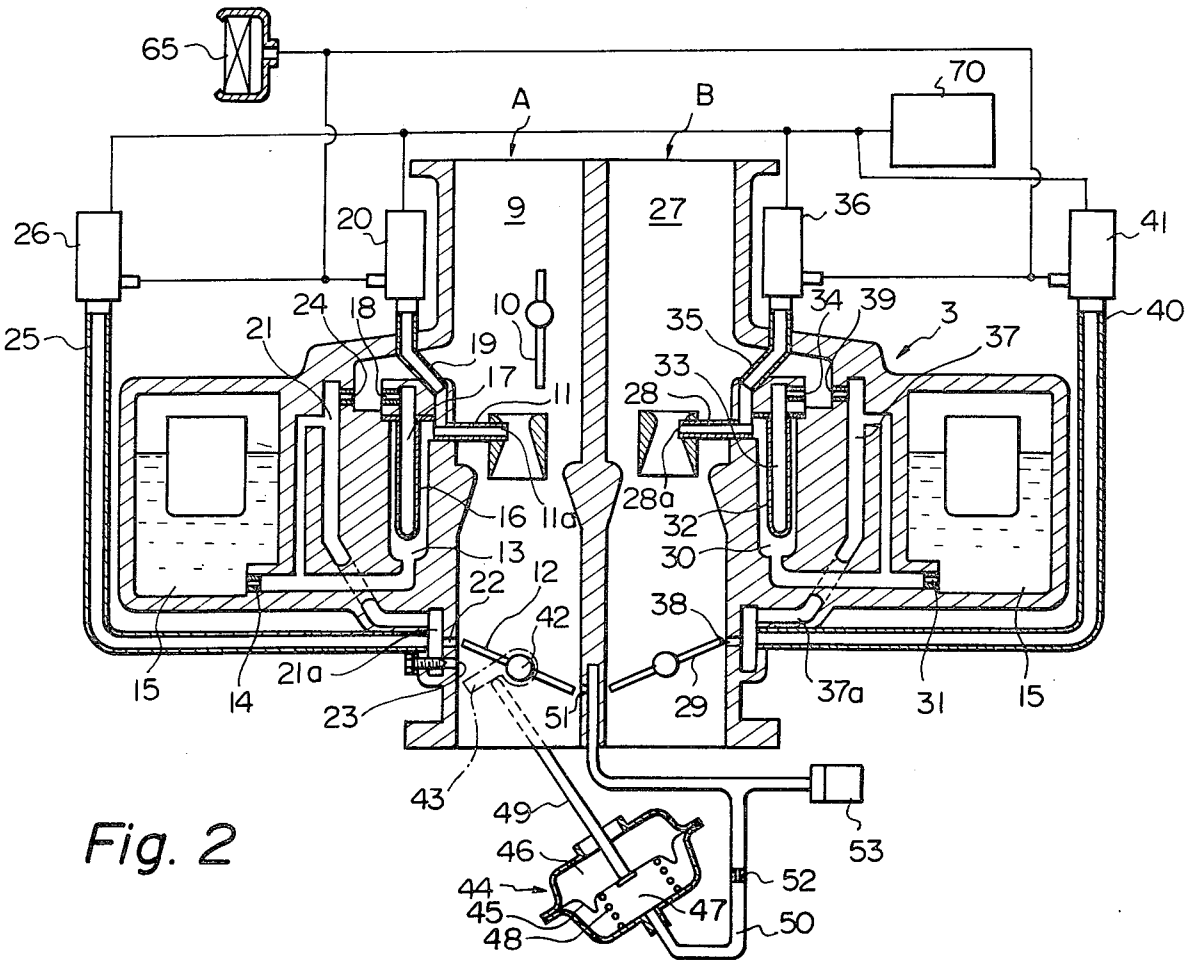
FIG. 2 is a cross-sectional side view of a carburetor according to the present invention.

In FIG. 1, 1 designates an engine body, 2 an intake manifold, 3 a carburetor mounted on the intake manifold 2 and 4 designates an air cleaner; 5 designates an exhaust manifold, 6 an exhaust pipe, 7 a three way catalytic converter, and 8 an oxygen concentration detector arranged in the exhaust manifold 2. Referring to FIG. 2, a carburetor 3 comprises a primary carburetor A and a secondary carburetor B. The primary carburetor A comprises an air horn 9, a choke valve 10, a main nozzle tube 11 having a nozzle mouth 11*a* and a primary throttle valve 12. The main nozzle tube 11 is connected to a float chamber 15 via a main fuel passage 13 and a main jet 14. An emulsion tube 16 is arranged in the main fuel passage 13, and the interior chamber 17 of the emulsion tube 16 is connected to the air horn 9 via a fixed jet 18. In addition, the inner end of the main nozzle tube 11 is connected to an electromagnetic control valve 20 via an air bleed conduit 19. A slow fuel passage 21 is branched off from the main fuel passage 13, and connected to a fuel outflow chamber 21*a* having a slow fuel port 22 and an idle fuel port 23 which open into the air horn 9 in the vicinity of the primary throttle valve 12. In addition, the slow fuel passage 21 is connected to the air horn 9 via jet 24 and the fuel outflow chamber 21*a* is connected to an electromagnetic control valve 26 via an air bleed conduit 25.

The secondary carburetor B comprises an air horn 27, a main nozzle tube 28 having a nozzle mouth 28*a* and a secondary throttle valve 29. The main nozzle tube 28 is connected to the float chamber 15 via a main fuel passage 30 and a main jet 31. An emulsion tube 32 is arranged in the main fuel passage 30 and the interior chamber 33 of the emulsion tube 32 is connected to the air horn 27 via a fixed jet 34. In addition, the inner end of the main nozzle tube 28 is connected to an electromagnetic control valve 36 via an air bleed conduit 35. A slow fuel passage 37 is branched off from the main fuel passage 30 and connected to a fuel outflow chamber 37*a* having a flow fuel port 38 which opens into the air horn 27 in the vicinity of the secondary throttle valve 29. The slow fuel passage 37 is connected to the air horn 27 via a fixed jet 39 and the fuel outflow chamber 37*a* is connected to an electromagnetic control valve 41 via an air bleed conduit 40. In addition, the carburetor 3 comprises a choke valve actuating mechanism (not shown) for automatically fully closing the choke valve 10 when an engine is started and for gradually opening the choke valve 10 as the temperature of an engine is increased.

Figure 3:
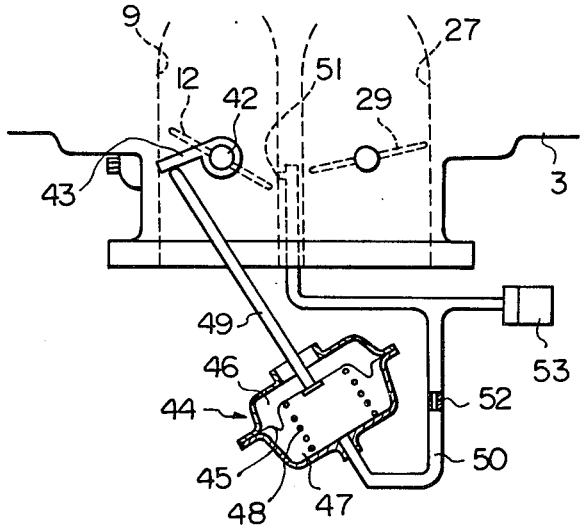
FIG. 3 is a side view of a portion of the carburetor illustrated in FIG. 2.

As illustrated in FIGS. 2 and 3, the carburetor 3 comprised a throttle opening degree control device 44 which cooperates with an arm 43 fixed onto a valve shaft 42 of the primary throttle valve 12. The throttle opening degree control device 44 has in its housing an atmospheric pressure chamber 46 and a pressure control chamber 47 which are separated by a diaphragm 45, and a compression spring 48 is arranged in the pressure control chamber 47 for biasing the diaphragm 45 towards the atmospheric pressure chamber 46. A control rod 49 is fixed onto the diaphragm 45 and arranged so that the tip of the control rod 49 is engageable with the arm 43. In addition, the pressure control chamber 47 is connected via a conduit 50 to a port 51 which is open to the air horn 9, and a jet 52 is inserted into the conduit 50. The port 51 is so arranged that it opens into the air horn 9 located downstream of the primary throttle valve 12 when the primary throttle valve 12 is in the idling position as illustrated in FIG. 2, but opens into the air horn 9 located upstream of the primary throttle valve 12 when the primary throttle valve 12 is opened as illustrated in FIG. 3. A vacuum sensitive switch 53 is arranged in the conduit 50 for detecting the level of vacuum acting on the port 51.

When the primary throttle valve 12 is closed from a fully opening state for decelerating the engine, the arm 43 comes into engagement with the tip of the control rod 49 at a position wherein the primary throttle valve 12 is slightly open as illustrated in FIG. 3. At this time, since the primary throttle valve 12 is biased in the counter-clockwise direction by means of a spring (not shown), the diaphragm 45 is pushed towards the pressure control chamber 47 against the compression spring 48. As a result of this, air, contained in the pressure control chamber 47, gradually escapes therefrom via the jet 52 and, thus, the primary throttle valve 12 is gradually closed to an idling position illustrated in FIG. 2. When the primary throttle valve 12 reaches the idling position, since the port 51 opens into the air horn 9 located downstream of the primary throttle valve 12, the vacuum acts on the pressure control chamber 47 and the vacuum sensitive switch 53.

If the primary throttle valve 12 is abruptly closed to the idling position when the engine is decelerated, since a great vacuum is produced in the intake manifold 2 (FIG. 1), liquid fuel, adhering onto the inner wall of the intake manifold 2, is instantaneously vaporized. As a result of this, the mixture, fed into the cylinder, temporarily becomes rich. If the mixture temporarily becomes rich as mentioned above, since the air bleed controlling operation cannot follow such a temporal enrichment, a large amount of unburned HC and CO is discharged into the exhaust passage of the engine. However, in the embodiment illustrated in FIG. 2, since the primary throttle valve 12 is gradually closed to the idling position when the engine is decelerated as mentioned above, the mixture, fed into the cylinder, does not temporarily become rich and, therefore, the air bleed controlling operation is able to follow a change in the air-fuel ratio of the mixture fed into the cylinder. As a result of this, it is possible to prevent a large amount of unburned HC and CO from being discharged into the exhaust passage of the engine.

Figure 4:
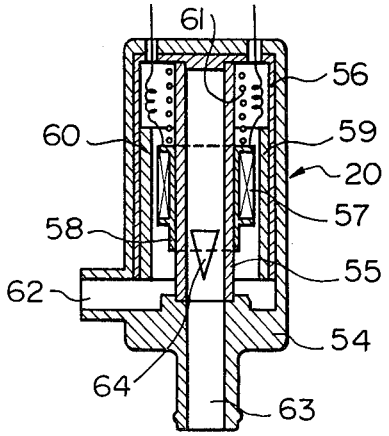
FIG. 4 is an enlarged cross-sectional side view of an electromagnetic control valve.

All the electromagnetic control valves 20, 26, 36, 41 have the same construction and, therefore, the construction of only the electromagnetic control valve 20 will be hereinafter described with reference to FIG. 4. Referring to FIG. 4, the electromagnetic control valve 20 comprises a pair of hollow cylindrical stators 55, 56 made of ferromagnetic material and arranged in a housing 54, a sliding sleeve 58 slidably inserted onto the stator 55 and supporting a coil 57 thereon, cylindrical split permanent magnets 59, 60 fixed onto the inner wall of the stator 56, and a compression spring 61 for urging the sliding sleeve 58 downwards in FIG. 4. In addition, an air inlet 62, formed in the housing 54, is connected to the atmosphere via the air filter 65 (FIG. 2) and an air outlet 63, formed in the housing 54, is connected to the air bleed conduit 19 (FIG. 2). A triangular shaped opening 64 is formed on the stator 55, and the air inlet 62 and the air outlet 63 are interconnected to each other via the opening 64. The cylindrical permanent magnets 59, 60 are so formed that, for example, the polarity of insides thereof is "N" and the polarity of the outsides thereof is "S." Consequently, a radial field is formed within the cylindrical permanent magnets 59, 60. The coil 57 is wound so that, when an electric current flows in the coil 57, the coil 57 is subjected to a force causing the coil 57 to move upward in FIG. 4. The above-mentioned force is strengthened as the amount of electric current fed into the coil 57 is increased. Therefore, the sliding sleeve 58 moves upward in FIG. 4 against the spring force of the compression spring 61 as the amount of electric current fed into the coil 57 is increased. Thus, it will be understood that the electromagnetic control valve 20 forms a linear motor. As illustrated in FIG. 4, the opening area of the triangular shaped opening 64 is increased as the sliding sleeve 58 moves upward in FIG. 4. Therefore, the amount of air fed into the fuel within the main nozzle tube 11 (FIG. 2) via the electromagnetic control valve 20 and the air bleed conduit 19 is increased as the amount of electric current fed into the coil 57 is increased. If the amount of air fed into the main nozzle tube 11 is increased, the density of fuel flowing out from the nozzle mouth 11*a* is reduced and, thus, the air-fuel ratio of the mixture formed in the carburetor 3 is increased. When an electric current is not fed into the coil 57, the sliding sleeve 58 completely closes the triangular shaped opening 64 and, therefore, at this time the air stream passing through the electromagnetic control valve 20 is completely shut off. As illustrated in FIGS. 1 and 2, the coil 57 (FIG. 4) of the electromagnetic control valve 20 is connected to an electronic control unit 70.

Figure 6:
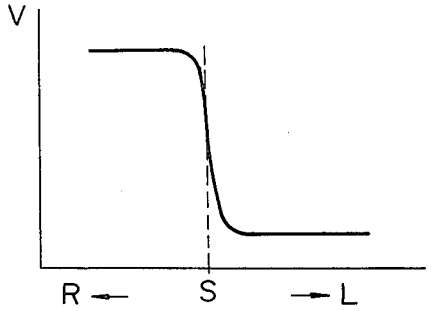
FIG. 6 is a graph illustrating a change in output voltage of an oxygen concentration detector.
Figure 5:
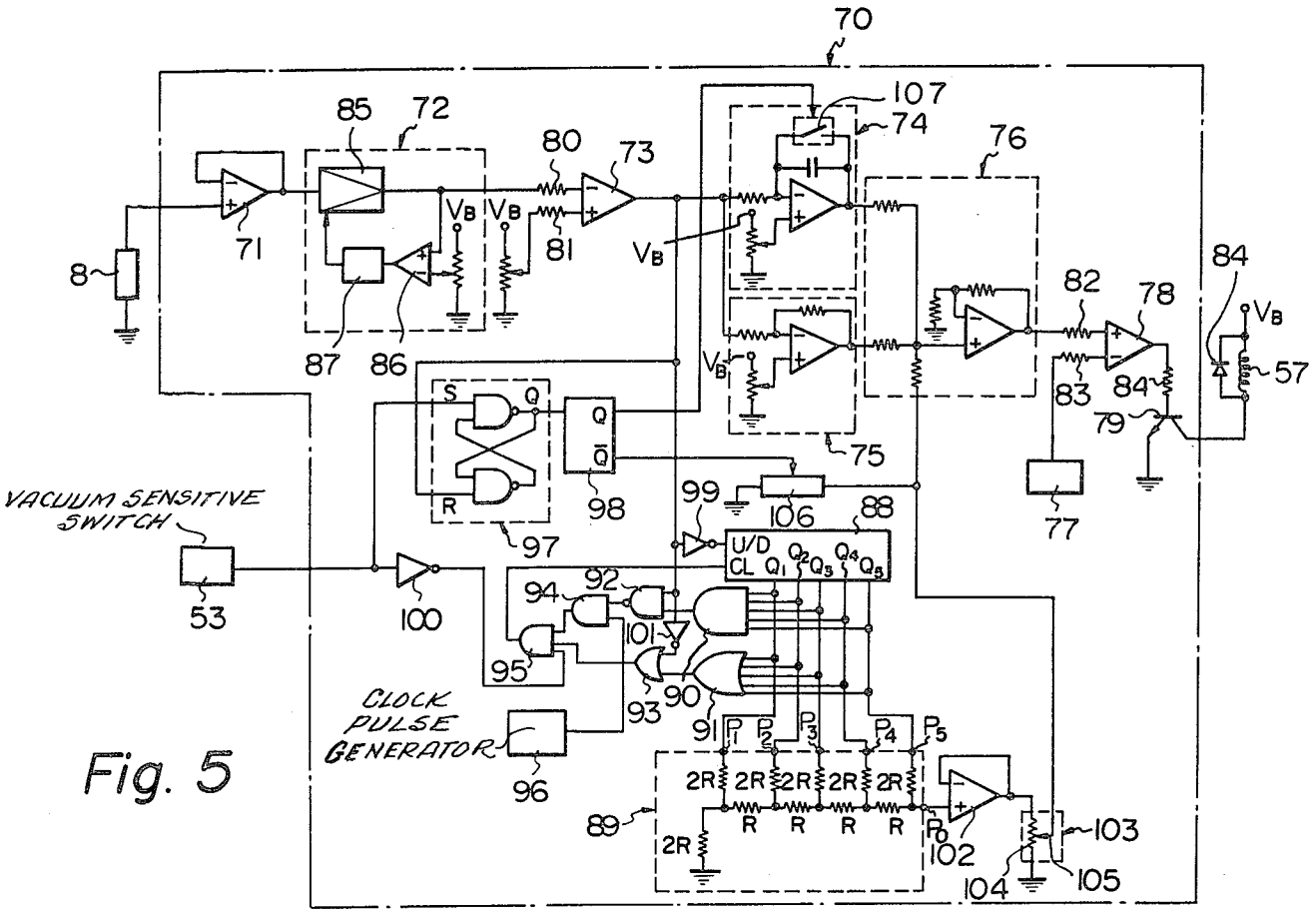
FIG. 5 is a circuit diagram of an electronic control circuit according to the present invention.

FIG. 5 illustrates a circuit diagram of the electronic control unit 70. In FIG. 5, $V_B$ indicates a power supply voltage. Referring to FIG. 5, the oxygen concentration detector 8 illustrated in FIG. 1, is illustrated by a block 8. As illustrated in FIG. 6, the oxygen concentration detector 8 produces an output voltage of about 0.1 volt when the exhaust gas is an oxidizing atmosphere, that is, when an air-fuel ratio of the mixture fed into the cylinder of an engine is larger than the stoichiometric air-fuel ratio. On the other hand, the oxygen concentration detector 8 produces an output voltage of 0.9 volts when the exhaust gas is a reducing atmosphere, that is, when an air-fuel ratio of the mixture fed into the cylinder of an engine is less than the stoichiometric air-fuel ratio. In FIG. 6, the ordinate V indicates an output voltage of the oxygen concentration detector 8, and the abscissa indicates an air-fuel ratio of the mixture fed into the cylinder of an engine. In addition, in the abscissa, S indicates the stoichiometric air-fuel ratio, and L and R indicate the lean side and the rich side of the stoichiometric air-fuel ratio, respectively.

In FIG. 5, the electronic control unit 70 comprises a voltage follower 71, an AGC circuit 72, a first comparator 73, an integrating circuit 74, a proportional circuit 75, an adder circuit 76, a saw tooth shaped wave generating circuit 77, a second comparator 78 and a transistor 79. The output terminal of the oxygen concentration detector 8 is connected to the non-inverting input terminal of the voltage follower 71 and the output terminal of the voltage follower 71 is connected to the input terminal of the AGC circuit 72. The output terminal of the AGC circuit 72 is connected to the inverting input terminal of the first comparator 73 via a resistor 80 and a reference voltage of about 0.4 volts is applied to the non-inverting input terminal of the first comparator 73 via a resistor 81. The output terminal of the first comparator 73 is connected, on one hand, to the input terminal of the integrating circuit 74 and, on the other hand, to the input terminal of the proportional circuit 75. The output terminal of the integrating circuit 74 is connected to a first input terminal of the adder circuit 76 and the output terminal of the proportional circuit 75 is connected to a second input terminal of the adder circuit 76. The output terminal of the adder circuit 76 is connected to the non-inverting input terminal of the second comparator 78 via a resistor 82, and the inverting input terminal of the second comparator 78 is connected to the saw tooth shaped wave generating circuit 77 via a resistor 83. The output terminal of the second comparator 78 is connected to the base of the transistor 79 via a resistor 84. The emitter of the transistor 79 is grounded and the collector of the transistor 79 is connected to the coil 57 of the electromagnetic control valve 20 (FIG. 3). In addition, a diode 84 for absorbing surge current is connected, in parallel, to the coil 57.

Figure 7:
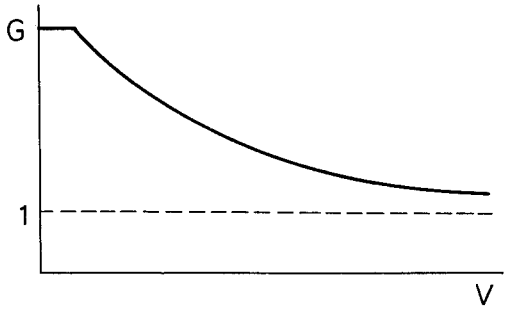
FIG. 7 is a graph illustrating a change in gain of an AGC circuit.
Figure 8:
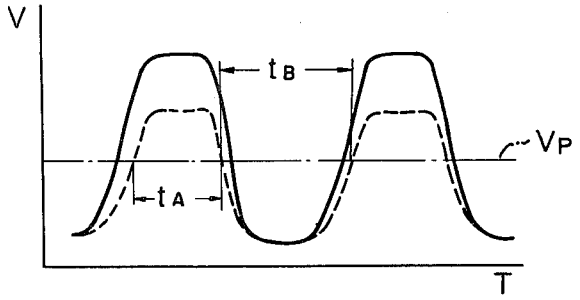
FIG. 8 is a graph illustrating a change in output voltage of an AGC circuit.

The AGC circuit 72 comprises a variable gain amplifier 85, a comparator 86 and an integrating circuit 87. The non-inverting input terminal of the comparator 86 is connected to the output terminal of the variable gain amplifier 85 and a fixed voltage is applied to the inverting terminal of the comparator 86. The output terminal of the comparator 86 is connected to the input terminal of the integrating circuit 87, and the gain of the variable gain amplifier 85 is controlled by the output voltage of the integrating circuit 87, as illustrated in FIG. 7. In FIG. 7, the ordinate G indicates gain of the variable gain amplifier 85 and the abscissa V indicates output voltage of the integrating circuit 87. When the temperature of the oxygen concentration detector 8 is less than, for example, 400° C., the oxygen concentration detector 8 does not produce an output voltage. On the other hand, when the temperature of the oxygen concentration detector 8 is increased beyond, for example, 400° C., the oxygen concentration detector 8 produces an output voltage, as illustrated in FIG. 6. When the oxygen concentration detector 8 produces an output voltage as illustrated in FIG. 6 and, thus, the feedback controlling operation of the electric control circuit 70 is started, the oxygen concentration detector 8 alternately produces the high level output and low level output. The output signal of the oxygen concentration detector 8 is fed into the AGC circuit 72 via the voltage follower 71 and, as a result, a voltage, illustrated by the solid line in FIG. 8, is produced at the output terminal of the variable gain amplifier 85. In FIG. 8, the ordinate V indicates output voltage of the variable gain amplifier 85 and the abscissa T indicates time. In addition, in FIG. 8, $V_p$ indicates a fixed voltage applied to the inverting input terminal of the comparator 86. If the output voltage of the oxygen concentration detector 8 is reduced and, thereby, the output voltage of the variable gain amplifier 85 is reduced as illustrated by the broken line in FIG. 8, the length of time $t_B$, during which the comparator 86 produces the high level output, becomes longer than the length of time $t_A$, during which the comparator 86 produces the low level output. The integrating circuit 87 is so constructed that the output voltage thereof is reduced as the ratio of $t_B/t_A$ is increased. From FIG. 7, it will be understood that the gain of the variable gain amplifier 85 is increased as the ratio $t_B/t_A$ is increased. Therefore, the peak of the output voltage of the variable gain amplifier 85 is pulled up from the voltage, illustrated by the broken line in FIG. 8, to the voltage illustrated by the solid line in FIG. 8. Consequently, the peak of the output voltage produced at the output terminal of the AGC circuit 72 is maintained constant, independently of the level of the peak of the output voltage of the oxygen concentration detector 8.

Figure 9:
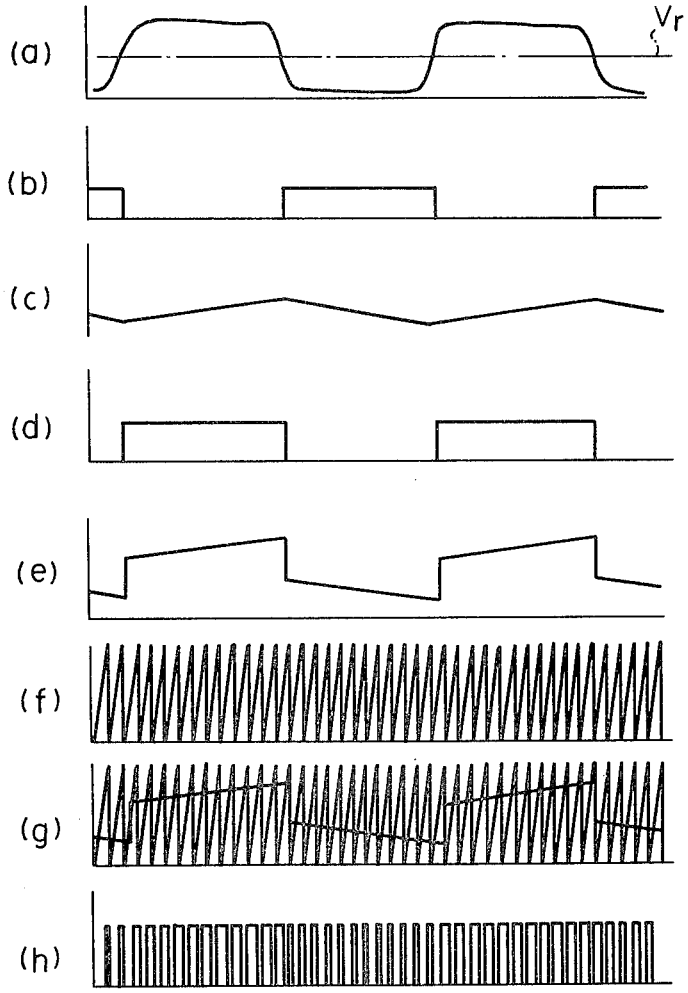
FIG. 9 is a time chart illustrating a change in voltage in an electronic control unit.

FIG. 9(*a*) illustrates the output voltage of the AGC circuit 72 illustrated in FIG. 5. In addition, in FIG. 9(*a*), $V_r$ indicates the reference voltage applied to the non-inverting input terminal of the first comparator 73. The first comparator 73 produces the high level output when the output voltages of the AGC circuit 72 is reduced below the reference voltage $V_r$. Thus, the first comparator 73 produces an output voltage as illustrated in FIG. 9(*b*). The output voltage of the first comparator 73 is integrated in the integrating circuit 74 and, as a result, the integrating circuit 74 produces an output voltage as illustrated in FIG. 9(*c*). On the other hand, the output voltage of the first comparator 73 is amplified in the proportional circuit 75 and, thus, the proportional circuit 75 produces an output voltage as illustrated in FIG. 9(*d*). The output voltage of the integrating circuit 74 and the output voltage of the proportional circuit 75 are added in the adder circuit 76 and, thus, the adder circuit 76 produces an output voltage as illustrated in FIG. 9(*e*). On the other hand, the saw tooth shaped wave generating circuit 77 produces a saw tooth shaped output voltage of a fixed frequency as illustrated in FIG. 9(*f*). The output voltage of the adder circuit 76 and the output voltage of the saw tooth shaped wave generating circuit 77 are compared in the second comparator 78 as illustrated in FIG. 9(*g*). The second comparator 78 produces the high level output when the output voltage of the adder circuit 76 becomes larger than that of the saw tooth shaped wave generating circuit 77. Consequently, the second comparator 78 produces continuous pulses, as illustrated in FIG. 9(*h*), and the widths of the continuous pulses are proportional to the level of the output voltage of the adder circuit 76. An electric current fed into the coil 57 is controlled by the continuous pulses, so that the amount of electric current fed into the coil 57 is increased as the widths of the continuous pulses are increased. From FIG. 9, it will be understood that, when the AGC circuit 72 produces the high level output, that is, when the air-fuel ratio of mixture fed into the cylinder of an engine becomes smaller than the stoichiometric air-fuel ratio, the widths of the continuous pulses produced at the output terminal of the second comparator 78 are increased, and thereby, the amount of electric current fed into the coil 57 is increased. If the amount of electric current fed into the coil 57 is increased, the opening area of the triangle shaped openings 64 (FIG. 4) of the electromagnetic control valves 20, 26, 36, 41 is increased, as mentioned previously. As a result of this, in FIG. 2, since the amount of air fed into the main nozzle pipes 11, 28 and the fuel outflow chambers 21*a*, 37*a* is increased, an air-fuel ratio of the mixture, fed into the cylinder of an engine, becomes large. After this, when an air-fuel ratio of the mixture fed into the cylinder of an engine becomes larger than the stoichiometric air-fuel ratio, the AGC circuit 72 (FIG. 5) produces the low level output. As a result of this, since the amount of electric current fed into the coil 57 is reduced, and thereby, the amount of air fed into the main nozzle pipes 11, 28 and the fuel outflow chambers 21*a*, 37*a* is reduced, an air-fuel ratio of the mixture fed into the cylinder of an engine becomes small. After this, when an air-fuel ratio of the mixture fed into the cylinder of an engine becomes smaller than the stoichiometric air-fuel ratio, the AGC circuit 72 (FIG. 5) produces the high level output. As a result of this, since the amount of air fed into the main nozzle pipes 11, 28 and the fuel outflow chambers 21*a*, 37*a* is increased, an air-fuel ratio of the mixture fed into the cylinder of an engine becomes large again. Thus, an air-fuel ratio of the mixture fed into the cylinder of an engine becomes equal to the stoichiometric air-fuel ratio.

In FIG. 5, the electronic control unit 70 further comprises a binary reversible counter 88 (a binary up-down counter), a ladder network 89 having first resistors of resistance value R and second resistors of resistance value 2R, a 5-input AND gate 90, a 5-input OR gate 91, a NAND gate 92, an OR gate 93, and AND gate 94, a 3-input AND gate 95, a clock pulse generator 96, a SR flip flop 97 and a monostable multivibrator 98. The input terminal U/D of the reversible counter 88 is connected to the output terminal of the first comparator 73 via an inverter 99, and the clock input terminal CL of the reversible counter 88 is connected to the output terminal of the AND gate 95. The output teminal of the AND gate 94 is connected to the first input terminal of the AND gate 95, and the output teminal of the OR gate 93 is connected to the second input terminal of the AND gate 95. In addition, the vacuum sensitive switch 53 (FIG. 2) is connected to the third input terminal of the AND gate 95 via an inverter 100. The output terminal of the NAND gate 92 is connected to one of the input terminals of the AND gate 94, and the clock pulse generator 96 is connected to the other input terminal of the AND gate 94. The output terminal of the first comparator 73 is connected to one of the input terminals of the NAND gate 92 via the inverter 99, and the output terminal of the AND gate 90 is connected to the other output terminal of the NAND gate 92. In addition, the output terminal of the first comparator 73 is connected to one of the input terminals of the OR gate 93, and the output terminal of the OR gate 91 is connected to the other input terminal of the OR gate 93. The output terminals $Q_1$, $Q_2$, $Q_3$, $Q_4$ and $Q_5$ of the reversible counter 88 produce the output signals of zero bit, first bit, second bit, third bit and fourth bit, respectively, and connected to the corresponding input terminals $P_1$, $P_2$, $P_3$, $P_4$ and $P_5$ of the ladder network 89. The input terminals of the AND gate 90 are connected to the corresponding output terminals $Q_1$, $Q_2$, $Q_3$, $Q_4$ and $Q_5$ of the reversible counter 88, and the input terminals of the OR gate 91 are also connected to the corresponding output terminals $Q_1$, $Q_2$, $Q_3$, $Q_4$ and $Q_5$ of the reversible counter 88. The output terminal $P_o$ of the ladder network 89 is connected to the non-inverting input terminal of a voltage follower 102, and the output terminal of the voltage follower 102 is grounded via the fixed resistor 104 of a variable resistor 103. The variable resistor 103 has a slide 105 which is in electrically contact with the fixed resistor 104. This slide 105 is connected to the third input terminal of the adder circuit 76 on one hand, and grounded via an analog switch 106 on the other hand.

The set input terminal S of the SR flip flop 97 is connected to the vacuum sensitive switch 53, and the reset input terminal R of the SR flip flop 97 is connected to the output terminal of the first comparator 73. The output terminal Q of the SR flip flop 97 is connected to the input terminal of the monostable multivibrator 98. In addition, the inverting input terminal of the integrating circuit 74 is connected to the output terminal thereof via a normally opened type electronic switch 107. The electronic switch 107 is controlled by the output signal produced at the non-inverting output terminal Q of the monostable multivibrator 98, and the analog switch 106 is controlled by the output signal produced at the inverting output terminal $\overline{Q}$ of the monostable multivibrator 98. The vacuum sensitive switch 53 is in the OFF position when the level of vacuum setting on the port 51 (FIG. 2) is smaller than about −330 mmHg, but is turned to the ON position when the level of vacuum acting on the port 51 becomes greater than −330 mmHg.

The output voltage of the first comparator 73 is applied to the input terminal U/D of the reversible counter 88 via the inverter 99, and the clock pulses are fed into the clock input terminal CL of the reversible counter 88 from the clock pulse generator 96 via the AND gates 94, 95. Since the output terminal of the AGC circuit 72 is connected to the inverting input terminal of the first comparator 73 as illustrated in FIG. 5, when the oxygen concentration detector 8 produces the high level output, that is, when the AGC circuit 72 produces the high level output, the first comparator 73 produces the low level output as illustrated in FIGS. 9(*a*) and 9(*b*). However, since the inverter 99 is inserted between the output terminal of the first comparator 73 and the input terminal U/D of the reversible counter 88, when the oxygen concentration detector 8 produces the high level output, the output voltage, applied to the input terminal U/D of the reversible counter 88, becomes high. The clock pulses, fed into the clock input terminal CL of the reversible counter 88, are counted up in the reversible counter 88 when the voltage, applied to the input terminal U/D of the reversible counter 88, becomes high, while the clock pulses are counted down in the reversible counter 88 when the voltage, applied to the input terminal U/D, becomes low. Consequently, the more the time period, during which the oxygen concentration detector 8 produces the high level output, lengthens, the more the count value of the reversible counter 88 becomes large. Therefore, it will be understood that the count value of the reversible counter 88 represents the mean value of the output voltage of the oxygen concentration detector 8. The ladder network 89 is a well known D-A converter for converting the binary output signal of the reversible counter 88 to the corresponding analog signal and, therefore, the voltage, which is proportional to the count value of the reversible counter 88, is produced at the output terminal of the voltage follower 102. The voltage, which is proportional to the output voltage of the voltage follower 102, is applied to the slide 105 and then applied to the adder circuit 76 and the analog switch 106.

The AND gate 90 is provided for preventing the overflow of the reversible counter 88 from occurring. That is, when all the output signals, produced at the output terminals $Q_1$, $Q_2$, $Q_3$, $Q_4$ and $Q_5$ of the reversible counter 88, become logic "1," the AND gate 90 produces the high level output. At this time, during the time the voltage, applied to the input terminal V/D of the reversible counter 88, is high, the NAND gate 92 produces the low level output. As a result of this, since the clock pulses, issued from the clock pulse generator 96, are inhibited at the AND gate 94, the count up of the reversible counter 88 is not carried out.

On the other hand, the OR gate 91 provided for preventing the count down of the reversible counter 88 from being carried out after all the output signals, produced at the output terminals $Q_1$, $Q_2$, $Q_3$, $Q_4$ and $Q_5$ of the reversible counter 88, becomes logic "0." That is, when all the output signals, produced at the output terminals $Q_1$, $Q_2$, $Q_3$, $Q_4$ and $Q_5$, become logic "0," the OR gate 91 produces the low level output. At this time, during the time the voltage applied to the input terminal V/D of the reversible counter 88 is low, the OR gate 93 produces the low level output. As a result of this, since the clock pulses, issued from the clock pulse generator 96, are inhibited at the AND gate 95, the count down of the reversible counter 88 is not carried out.

Figure 10:
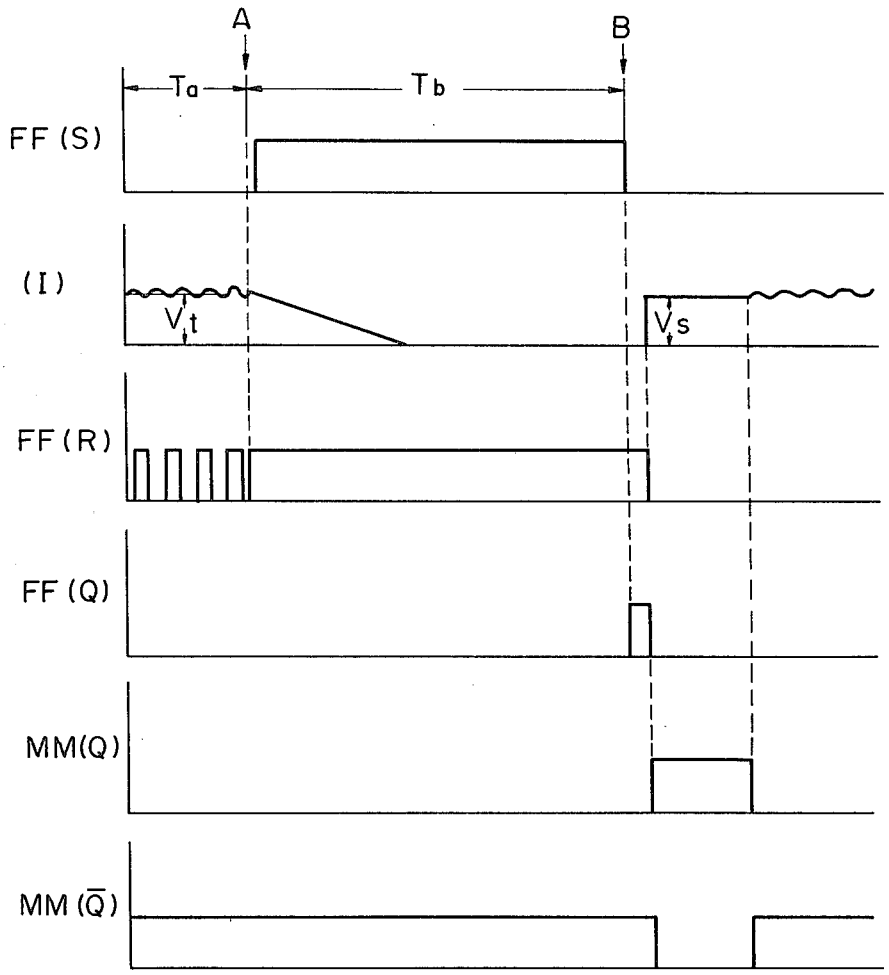
FIG. 10 is a time chart also illustrating a change in voltage in an electronic control circuit.

The operation of the air-fuel ratio control device according to the present invention will be hereinafter described with reference to FIG. 10. In FIG. 10, FF(S) indicates the voltage applied to the set input terminals S of the SR flip flop 97; (I) indicates the voltage produced at the output terminal of the adder circuit 76; FF(R) indicates the voltage applied to the reset input terminal R of the flip flop 97; FF(Q) indicates the voltage produced at the output terminal Q of the SR flip flop 97; MM(Q) indicates the voltage produced at the non-inverting output terminal Q of the monostable multivibrator 98, and; MM($\overline{Q}$) indicates the voltage produced at the inverting output terminal Q of the monostable multivibrator 98.

In FIG. 10, $T_a$ indicates the time period during which the vehicle is driven, for example, at a high speed. At this time, since the primary throttle valve 12 (FIG. 2) is opened to a great extent, the pressure, acting on the port 51 (FIG. 2), is approximately equal to atmospheric pressure. As a result of this, since the vacuum sensitive switch 53 is in the OFF position as mentioned previously, the input voltage, applied to the set input terminal S of the flip flop 97, becomes low as illustrated by FF(S) in FIG. 10. In addition, during the time period $T_a$, since the feedback controlling operation of the electronic control unit 70 is carried out, the output voltage of the adder circuit 76 fluctuates as illustrated by (I) in FIG. 10, and the input voltage, applied to the reset input terminal R of the flip flop 97 alternately becomes high and low as illustrated by FF(R) in FIG. 10. However, since the potential of the set input terminal S of the SR flip flop 97, becomes low as mentioned above, the SR flip flop 97 produces the low level output of logic "0" as illustrated by FF(Q) in FIG. 10. At this time, since the potential of the non-inverting output terminal Q of the monostable multivibrator 98 is low as illustrated by MM(Q) in FIG. 10, the electronic switch 107 is in the OFF position as illustrated in FIG. 5. Contrary to this, since the potential of the inverting output terminal $\overline{Q}$ of the monostable multivibrator 98 is high as illustrated by MM($\overline{Q}$) in FIG. 10, the analog switch 106 is in the conductive state. Consequently, at this time, the slide 105 of the variable resistor 103 is grounded via the analog switch 106 and, thus, only the output voltage of the integrating circuit 74 and the output voltage of the proportional circuit 75 are added in the adder circuit 76.

Then, at A in FIG. 10, the primary throttle valve 12 is closed and, thus, deceleration of the vehicle is started. When the deceleration of the vehicle is started, since the air-fuel mixture, fed into the cylinder, becomes lean, the oxygen concentration detector 8 continues to produce the low level output. As a result of this, as illustrated by (I) in FIG. 10, the output voltage of the adder circuit 76 is gradually reduced with a time constant of the integrating circuit 75. On the other hand, when the deceleration of the vehicle is started, since the first comparator 73 produces the high level output, the voltage, applied to the reset input terminal R of the SR flip flop 97, becomes high as illustrated by FF(R) in FIG. 10. When the primary throttle valve 12 is closed, since the primary throttle valve 12 is gradually closed to the idling position by the throttle opening degree control device 44, the primary throttle valve 12 reaches the idling position a little while after the deceleration of the vehicle is started. At this time, since a great vacuum, the level of which is greater than −330 mmHg, is produced in the intake manifold 2 (FIG. 1), the vacuum sensitive switch 53 is turned to the ON position. When the vacuum sensitive switch 53 is turned to the ON position, the voltage, applied to the set input terminal S of the SR flip flop 97, becomes high as illustrated by FF(S) in FIG. 10. In addition, when the vacuum sensitive switch 53 is turned to the ON position, since the voltage, applied to the input terminal of the AND gate 95, which is connected to the vacuum sensitive switch 53, becomes low, the clock pulses, issued from the clock pulse generator 96, are inhibited at the AND gate 95. As a result of this, the counting operation of the reversible counter 88 is stopped. Consequently, the count value of the reversible counter 88, which has been set immediately before the deceleration of the vehicle is started, is stored. Therefore, it will be understood that the reversible counter 88 functions as a memory device.

The deceleration of the vehicle continues during the time period $T_b$ in FIG. 10 and, then, at B, the primary throttle valve 12 is opened for accelerating the vehicle. When the primary throttle valve 12 is opened, since the pressure, acting on the port 51, becomes approximately equal to the atmospheric pressure, the vacuum sensitive switch 53 is turned to the OFF position. At this time, since the voltage, applied to the set input terminal S of the SR flip flop 97, becomes low as illustrated by FF(S) in FIG. 10, the potential of the output terminal Q of the SR flip flop 97 becomes high as illustrated by FF(Q) in FIG. 10. On the other hand, when the primary throttle valve 12 is opened, since a rich mixture is fed into the cylinders of the engine, the output voltage of the first comparator 73 becomes low and, accordingly, the voltage, applied to the reset input terminal R of the SR flip flop 97, becomes low. When the voltage, applied to the reset input terminal R of the SR flip flop 97, becomes low as mentioned above, the potential of the output terminal Q of the SR flip flop 97 becomes low. The monostable multivibrator 98 is triggered by the trailing edge of the output pulse of the SR flip flop 78 and, thereby, the potential of the non-inverting output terminal Q of the monostable multivibrator 97 becomes high as illustrated by MM($\overline{Q}$) in FIG. 10. At the same time, the potential of the inverting output terminal $\overline{Q}$ of the monostable multivibrator 97 becomes low as illustrated by MM(Q) in FIG. 10. When the potential of the non-inverting output terminal Q of the monostable multivibrator 98 becomes high, the electronic switch 107 is turned to the ON position and, as a result, the output voltage of the integrating circuit 74 becomes equal to zero. On the other hand, when the potential of the inverting output terminal Q of the monostable multivibrator 98 becomes low, the analog switch 106 is changed to the non-conductive state and, thus, the voltage, applied to the slide 105 of the variable resistor 103, is applied to the adder circuit 76. Consequently, at this time, as illustrated by (I) in FIG. 10, since the sum $V_s$ of the output voltage of the proportional circuit 75 and the voltage applied to the slide 105 is produced at the output terminal of the adder circuit 76 and applied to the non-inverting terminal of the second comparator 78, the electromagnetic control valves 20, 26, 36, 41 are opened as soon as the acceleration of the vehicle is started. During the time the potential of the non-inverting output terminal Q of the monostable multivibrator 98 is high, the adder circuit 76 produces the output voltage $V_s$ and, when the potential of the non-inverting output terminal Q of the monostable multivibrator 98 becomes low, the feedback controlling operation of the electronic control unit 70 is started again.

It is preferable that the output voltage $V_s$ of the adder circuit 76 be 0.9 through 1.1 time the mean value $V_t$ (FIG. 10) of the output voltage which is produced at the output terminal of the adder circuit 76 before the deceleration of the vehicle is started. The output voltage of the proportional circuit 75 is smaller than the voltage applied to the slide 105 of the variable resistor 103 and is constant, and the voltage, applied to the slide 105, is proportional to the mean value $V_t$ of the output voltage of the adder circuit 76 as mentioned previously. Therefore, it is possible to easily set the voltage $V_s$ at a voltage which is 0.9 through 1.1 times the mean value $V_t$ by suitably adjusting the slide 105 of the variable resistor 103.

According to the present invention, when the vehicle is accelerated during deceleration, since the electromagnetic control values are instantaneously opened, it is possible to prevent an air-fuel mixture fed into the cylinders of an engine from becoming rich, and thus, it is possible to sufficiently reduce the amount of unburned HC and CO discharged from the engine.

While the invention has been described by reference to a specific embodiment chosen for purposes of illustration, it should be apparent that numerous modifications could be made thereto by those skilled in the art without departing from the basic concept and scope of the invention.

We claim:

1. An air-fuel ratio control device of an internal combustion engine having at least one cylinder, an intake passage and an exhaust passage, said device comprising: a carburetor arranged in the intake passage and having a throttle valve, said carburetor having a fuel reservoir and a fuel overflow passage which interconnects said reservoir to the intake passage;

an air bleed passage interconnecting said fuel outflow passage to the atmosphere for feeding air into said fuel outflow passage;

an air-fuel ratio detector arranged in the exhaust passage and detecting components of an exhaust gas in the exhaust passage for producing a detecting signal which has a potential level which becomes high or low when the air-fuel ratio of said mixture becomes smaller or larger than the stoichiometric air-fuel ratio, respectively;

a detecting signal processing circuit having a first comparator for comparing the level of the detecting signal of said air-fuel ratio detector with a reference voltage to produce an output voltage, said processing circuit having an integrating circuit for integrating the output voltage of said first comparator to produce a first control signal; a drive pulse generator in response to said first control signal for generating continuous drive pulses, each having a width which is proportional to the potential level of said first control signal, and; control valve means arranged in said air bleed passage and actuated in response to said drive pulses for increasing the flow area of said air bleed passage in accordance with an increase in the width of said drive pulse, wherein the improvement comprises: a vacuum sensitive switch in response to a vacuum within the intake passage located downstream of said throttle valve for producing a detecting signal when the level of vacuum within the intake passage located downstream of said throttle valve becomes greater than a predetermined level; memory means in response to the detecting signal of said vacuum sensitive switch for storing the mean value of the potential level of the detecting signal which is issued from said air-fuel ratio detector before the level of vacuum within the intake passage located downstream of said throttle valve becomes greater than said predetermined level; converting means for converting said mean value stored in said memory means to a corresponding second control signal; control signal generating means in response to the detecting signal of said air-fuel ratio detector and the detecting signal of said vacuum sensitive switch for producing a third control signal when the potential level of the detecting signal of said air-fuel ratio detector becomes high after the level of vacuum within the intake passage located downstream of said throttle valve becomes smaller than said predetermined level, and; switching means in response to the third control signal of said control signal generating means for temporarily changing a signal, input into said drive pulse generator, from said first control signal to said second control signal to temporarily generate the continuous drive pulses, each having a width which is proportional to the potential level of said second control signal when said control signal generating means produces said third control signal.

2. An air-fuel ratio control device as claimed in claim 1, wherein said carburetor has a port which opens into the intake passage located downstream of said throttle valve when said throttle valve is in the idling position, but opens into the intake passage located upstream of said throttle valve when said throttle valve is opened, said vacuum sensitive switch being actuated by the vacuum acting on said port.

3. An air-fuel ratio control device as claimed in claim 2, wherein said device comprises a throttle opening degree control apparatus cooperating with said throttle valve and actuated in response to the vaccuum acting on said port for gradually closing said throttle valve to the idling position.

4. An air-fuel ratio control device as claimed in claim 3, wherein said throttle opening degree control apparatus comprises a spring loaded diaphragm, a pressure control chamber separated by said diaphragm from the atmosphere and connected to said port via a restricted opening, and a control rod connected to said diaphragm and coming into engagement with said throttle valve when said throttle valve is closed to a predetermined opening degree.

5. An air-fuel ratio control device as claimed in claim 1, wherein said control valve means comprises a linear motor.

6. An air-fuel ratio control device as claimed in claim 1, wherein said carburetor is a fixed venturi type carburetor and comprises a primary air horn, a primary throttle valve arranged in said primary air horn, a secondary air horn and a secondary throttle valve arranged in said secondary air horn, said fuel outflow passage comprising a primary main fuel passage connected to said primary air horn, a primary slow fuel passage connected to said primary air horn at a position near said primary throttle valve, a secondary main fuel passage connected to said secondary air horn, and a secondary slow fuel passage connected to said secondary air horn at a position near said secondary throttle valve, said air bleed passage comprises a first passage, a second passage, a third passage and a fourth passage which are connected to said primary main fuel passage, said primary slow fuel passage, said secondary main fuel passage and said secondary slow fuel passage, respectively, said control valve means comprising a first valve, a second valve, a third valve and fourth valve which are arranged in said first passage, said second passage, said third passage and said fourth passage, respectively.

7. An air-fuel ratio control device as claimed in claim 6, wherein all of said first passage, said second passage, said third passage and said fourth passage are connected to the atmosphere via a common air filter.

8. An air-fuel ratio control device as claimed in claim 6, wherein said carburetor comprises a primary nozzle tube and a secondary nozzle tube which define said primary main fuel passage and said secondary main fuel passage therein, and have one end supported by inner walls of said primary air horn and said secondary air horn, respectively, said first passage and said third passage being connected to said one end of said primary nozzle tube and said secondary nozzle tube, respectively.

9. An air-fuel ratio control device as claimed in claim 6, wherein said primary slow fuel passage has a primary fuel outflow chamber located near said primary throttle valve and connected to said primary air horn via a slow fuel port and an idle fuel port, said secondary slow fuel passage having a secondary fuel outflow chamber located near said secondary throttle valve and connected to said secondary air horn via a slow fuel port, said second passage and said fourth passage being connected to said primary fuel outflow chamber and said secondary fuel outflow chamber, respectively.

10. An air-fuel ratio control device as claimed in claim 1, wherein said detecting signal processing circuit comprises an AGC circuit inserted between said air-fuel ratio detector and said first comparator.

11. An air-fuel ratio control device as claimed in claim 1, wherein said detecting signal processing circuit comprises a proportional circuit for producing an output voltage which is proportional to that of said first comparator, and an adder circuit for adding the output voltage of said proportional circuit and an output voltage of said integrating circuit to produce said first control signal.

12. An air-fuel ratio control device as claimed in claim 1, wherein said memory means is connected to said first comparator for calculating said mean value from the output voltage of said first comparator during the time said vacuum sensitive switch does not produce the detecting signal.

13. An air-fuel ratio control device as claimed in claim 12, wherein said memory means comprises a clock pulse generator generating clock pulses, a reversible counter counting up or counting down said clock pulses when the potential level of the detecting signal of said air-fuel ratio detector becomes high or low, respectively, and producing a binary output signal which represents said mean value, and a first inhibiting circuit in response to the detecting signal of said vacuum sensitive switch for inhibiting said clock pulses from being fed into said reversible counter when said vacuum sensitive switch produces the detecting signal.

14. An air-fuel ratio control device as claimed in claim 13, wherein said memory means comprises a second and a third inhibiting circuit in response to said binary output signal and the detecting signal of said vacuum sensitive switch for inhibiting said clock pulses from being fed into said reversible counter when all bits of said binary output signal becomes logic "1" or logic "0" and when the potential level of the detecting signal of said air-fuel ratio detector becomes high or low, respectively.

15. An air-fuel ratio control device as claimed in claim 13, wherein said converting means comprises a DA converter for converting said binary output signal to said second control signal.

16. An air-fuel ratio control device as claimed in claim 15, wherein said converting means comprises a variable resistor for adjusting the potential level of said second control signal.

17. An air-fuel ratio control device as claimed in claim 15, wherein said DA converter is a ladder network.

18. An air-fuel ratio control device as claimed in claim 1, wherein said control signal generating means comprises a trigger signal generator in response to the detecting signal of said air-fuel ratio detector and the detecting signal of said vacuum sensitive switch for producing a trigger signal when the potential level of the detecting signal of said air-fuel ratio detector becomes high after the level of vacuum within the intake passage located downstream of said throttle valve becomes smaller than said predetermined level, said control signal generating means further comprising a monostable multivibrator which produces said third control signal when said monostable multivibrator is triggered by said trigger signal.

19. An air-fuel ratio control device as claimed in claim 18, wherein said trigger signal generator comprises a SR flip flop having a set input terminal and a reset input terminal connected to said first comparator, said set input terminal being connected to said vacuum sensitive switch.

20. An air-fuel ratio control device as claimed in claim 1, wherein said drive pulse generator comprises a saw tooth shaped wave generator, and a second comparator having a first input terminal and a second input terminal connected to said saw tooth shaped wave generator, said switching means temporarily changing the signal, input into the first input terminal of said second comparator, from said first control signal to said second control signal during the time said control signal generating means produces said third control signal.

21. An air-fuel ratio control device as claimed in claim 20, wherein said switching means comprises a first electronic switch which electrically connects an input terminal of said integrating circuit to an output terminal of said integrating circuit during the time said control signal generating means produces said third control signal, said switching means further comprising a second electronic switch which permits said second control signal to be input to said drive pulse generator during the time said control signal generating means produces said third control signal.

22. An air-fuel ratio control device as claimed in claim 1, wherein said second control signal has a potential level which is 0.9 through 1.1 times the potential level of said mean value.

* * * * *